US006069586A

United States Patent [19]

Karlsson et al.

[11] Patent Number: 6,069,586

[45] **Date of Patent: *May 30, 2000**

[54] ANTENNA OPERATING WITH TWO ISOLATED CHANNELS

[75] Inventors: Dan Karlsson, Solna; Stefan Jonsson, Danderyd; Bo Karlsson, Osterskär, all of Sweden

[73] Assignee: Allgon AB, Akersberga, Sweden

[ * ] Notice: This patent issued on a continued prosecution application filed under 37 CFR 1.53(d), and is subject to the twenty year patent term provisions of 35 U.S.C. 154(a)(2).

[21] Appl. No.: 09/018,851

[22] Filed: Feb. 4, 1998

[30] Foreign Application Priority Data

Feb. 5, 1997 [SE] Sweden ..... 9700401

[51] Int. Cl.[7] ..... H01Q 1/38

[52] U.S. Cl. ..... 343/700 MS; 343/815

[58] Field of Search ..... 343/700 MS, 810, 343/815; H01Q 1/38

[56] References Cited

U.S. PATENT DOCUMENTS

| | | | |
|---|---|---|---|
| 5,008,681 | 4/1991 | Cavallaro et al. | 343/700 MS |
| 5,576,718 | 11/1996 | Buralli et al. | 343/700 MS |
| 5,742,258 | 4/1998 | Kumpfbeek et al. | 343/795 |
| 5,786,793 | 7/1998 | Maeda et al. | 343/700 MS |

FOREIGN PATENT DOCUMENTS

| | | |
|---|---|---|
| 4239785 | 6/1994 | Germany . |
| 2266809 | 11/1993 | United Kingdom . |
| WO89/07838 | 8/1989 | WIPO . |
| WO91/12637 | 8/1991 | WIPO . |

*Primary Examiner*—Hoanganh Le
*Assistant Examiner*—Shih-Chao Chen
*Attorney, Agent, or Firm*—Jacobson, Price, Holman & Stern, PLLC

[57] ABSTRACT

An antenna for receiving and/or transmitting electromagnetic waves, comprising an array of antenna elements including at least one longitudinal row of antenna elements (7) located at a distance (d) from each other, each such row of antenna elements being adapted to receive and/or transmit a dual polarized beam including two separate, mutually isolated channels. Along each longitudinal row of antenna elements, in the vicinity of the gap between a respective pair of adjacent antenna elements, preferably at the side of the centre line (C) of the row, there are disposed parasitic elements (8*a*, 8*b*) serving to influence the mutual coupling between said adjacent antenna elements in such a way as to improve the isolation between the separate channels.

12 Claims, 5 Drawing Sheets

ANTENNA OPERATING WITH TWO ISOLATED CHANNELS

BACKGROUND OF THE INVENTION

1. Field of the Invention

The present invention relates to an antenna for receiving and/or transmitting electromagnetic waves, comprising an array of antenna elements including at least one longitudinal row of antenna elements located at a distance from each other and parasitic elements located in the vicinity of the gaps there-between.

2. Description of the Related Art

Such antennas are used, inter alia, for the transfer of microwave carriers in telecommunication systems, in particular in base stations for cellular mobile telephones.

A broadband microstrip array antenna is described in GB-A-2266809 (Aerospatiale Societe Nationale Industrielle). In each longitudinal row of active antenna elements, in the form of rectangular patches, there are interposed parasitic elements in the form of patches which almost fill out the respective gap between adjacent active antenna elements. The slots between the adjacent active and passive patches are relatively small, whereby a strong coupling will occur so that the passive or parasitic elements form integral parts of the antenna and serve to broaden the effective bandwidth thereof.

SUMMARY OF THE INVENTION

In the present invention, on the other hand, the antenna array is of the kind operating with dual polarization defining two separate channels. Of course, the capacity of the system is improved by the provision of two separate channels, obtained by orthogonal polarization, for each particular frequency or frequency band. However, it is essential that the isolation between the two channels is very good, so as to obtain diversity.

The main object of the invention is to improve the isolation between the two channels by way of reducing the electromagnetic coupling between the two channels from one antenna element to an adjacent antenna element. Another object is to retain the isolation between the two channels within each one of the antenna elements.

The main object is achieved by the present invention in that

- each of said antenna elements is adapted to receive and/or transmit dual polarized, mutually orthogonal waves defining two mutually isolated channels,
- said parasitic elements include elongated portions extending longitudinally substantially in parallel to the centre line (C) of said row, and
- said parasitic elements are adapted to establish, in addition to an inevitable direct inter-channel coupling between the antenna elements in the respective pair of adjacent antenna elements, a further coupling between the antenna elements in said respective pair, said further coupling being phase shifted in such a way relative to said direct coupling as to substantially reduce the resulting total inter-channel coupling therebetween.

Thus, it has surprisingly turned out to be very effective to dispose elongated parasitic elements, in particular in the form of wires, strips and/or rods, substantially in parallel to the centre line of the row of antenna elements.

The parasitic elements may be made of an electrically conductive material, e.g. a metal or a carbon fibre material, or a dielectric material having a dielectric constant greater than 2, preferably between 2 and 6, e.g. polypropen or PVC.

It is not necessary to dispose parasitic elements near all gaps. Accordingly, it is possible to leave some of the gaps totally free or to position the elements in a zig-zag pattern along the row, e.g. by placing an element in registry with every second gap on each side of the row.

The most straight-forward arrangement is to place the parasitic elements symmetrically with respect to the centre line of the row, e.g. in registry with each gap or with most of the gaps.

Preferably, the parasitic elements are formed as wires, strips or rods. The length of these parasitic elements depends on the distance between adjacent antenna elements. Generally, they should have a length exceeding $\lambda/8$. As an alternative, they may be divided so as to form two or more sections, located longitudinally in series one after the other.

A convenient arrangement is to place the parasitic elements substantially in the same plane as the row of antenna elements, e.g., by disposing them on the same carrier layer. This is particularly useful in case the antenna elements are constituted by flat patches and the parasitic elements are formed as strips. The patches and the strips may then be placed on the same dielectric layer, which facilitates the production.

Underneath such a dielectric layer with patches, serving as radiating antenna elements, and strips, serving to improve the isolation between the two microwave channels, there is preferably at least one further dielectric layer with a feeding network and a ground plane layer of electrically conductive material, which is provided with apertures, preferably in the form of crossing slots, in registry with the respective patch on the upper dielectric layer. In this way, microwave energy can be fed through the feeding network via the apertures to the radiating patches.

If necessary, the antenna may include a metallic reflector structure along the back side of the row of antenna elements. Moreover, the antenna may comprise two or more rows located side by side so as to form a multilobe antenna unit.

BRIEF DESCRIPTION OF THE DRAWINGS

The invention will now be explained further in connection with two embodiments illustrated on the appended drawings.

DETAILED DESCRIPTION OF THE PREFERRED EMBODIMENTS

On the drawings, only those parts which are essential to the inventive concept are shown. Other structural parts and details have been left out for the sake of clarity.

Figure 1:
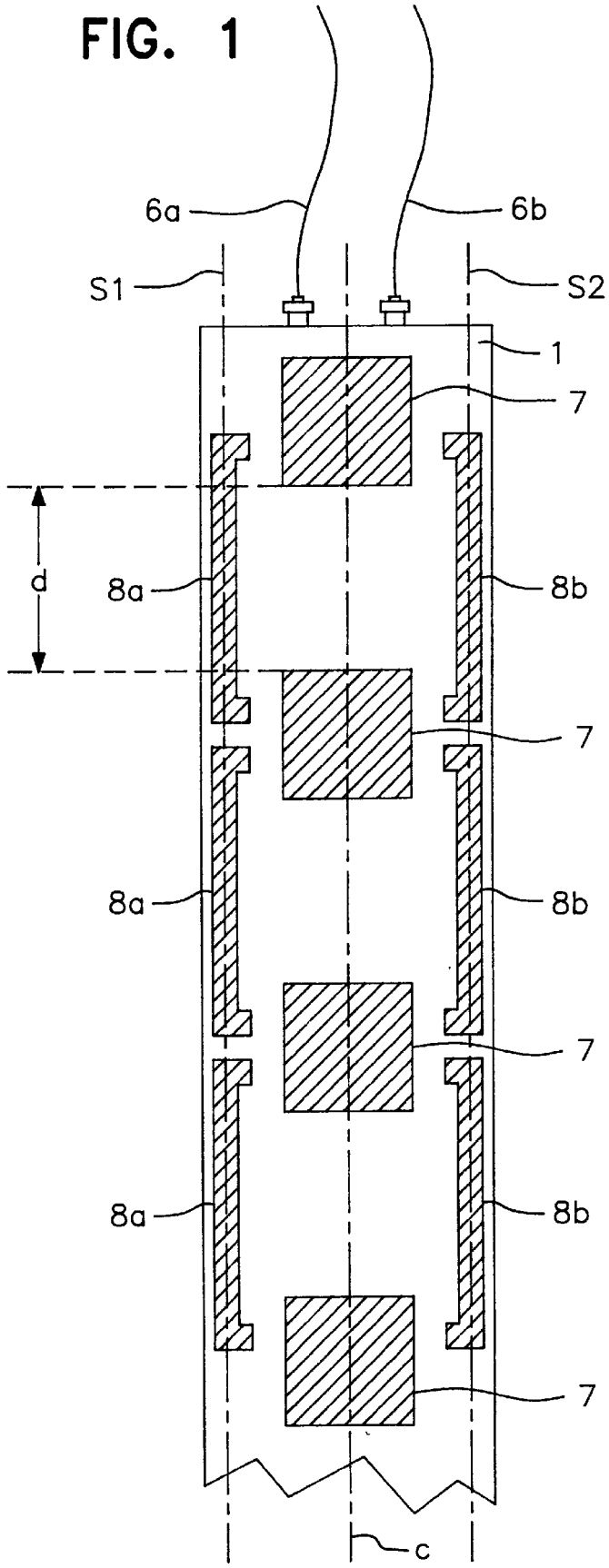
FIG. 1 shows schematically a planar view of an antenna according to a first embodiment with a row of antenna elements and parasitic strips arranged at each transversal side thereof.
Figure 2:
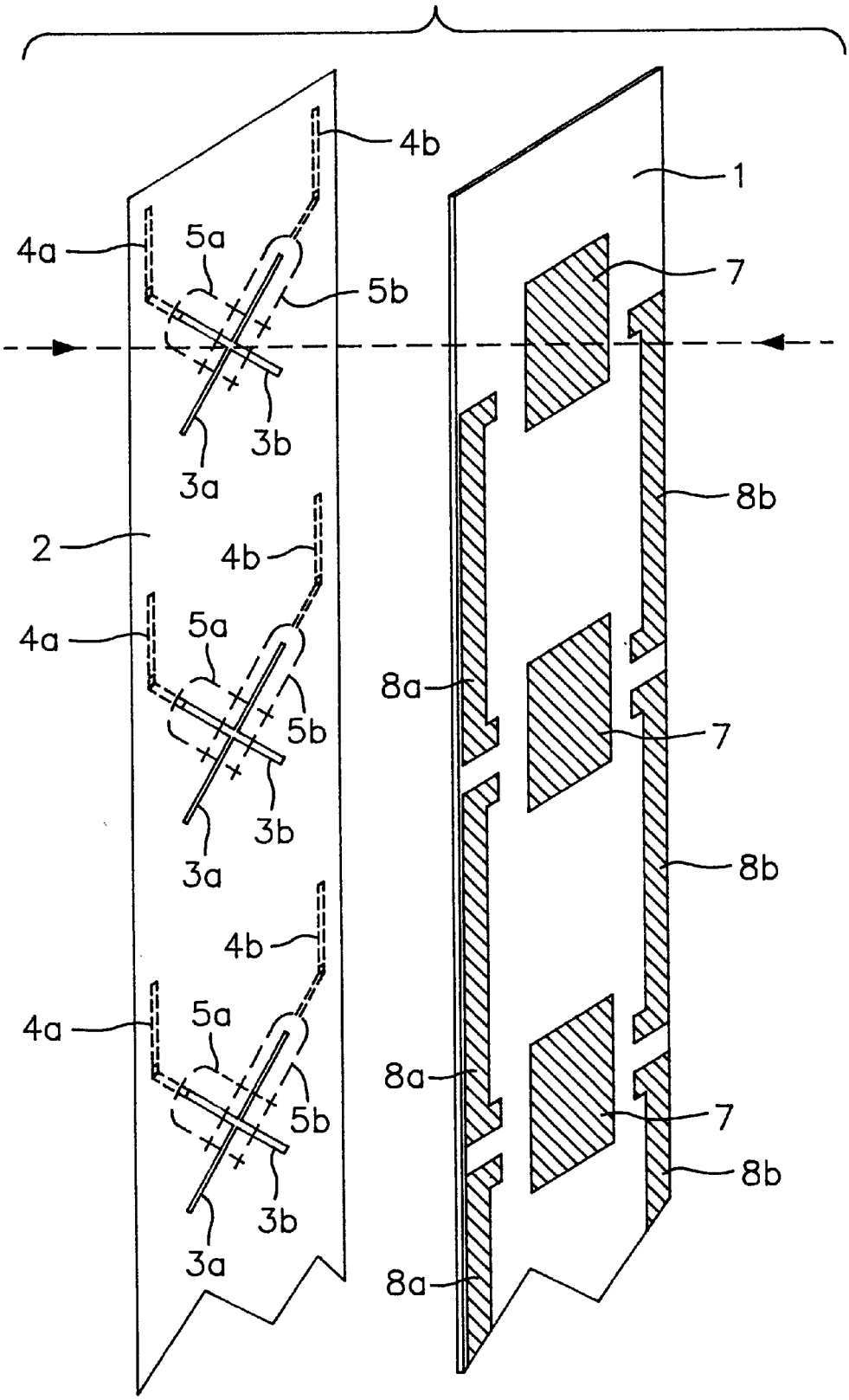
FIG. 2 shows schematically, in an exploded perspective view, two layers included in the antenna shown in FIG. 1.

The first embodiment of the antenna, shown in FIGS. 1 and 2, comprises at least two separate dielectric layers 1, 2 (FIG. 2) disposed in parallel but at a mutual distance from each other. On the back layer 2 (to the left in FIG. 2) there is a ground plane layer (not shown separately) of electrically conducting material and having a number of cross-shaped apertures 3*a*, 3*b* arranged in a longitudinal row. At the underside of the dielectric layer 2, there is a feeding network including feed lines 4*a*,4*b* and fork-shaped feed elements 5*a*, 5*b* in the form of micro strip lines, the feed lines 4*a* and the feed elements 5*a* being connected to a first microwave feed channel 6*a* (FIG. 1), and the feed lines 4*b* and the feed elements 5*b* being connected to a second microwave feed channel 6*b*.

The cross-shaped apertures 3*a*, 3*b* are each located in registry with (though rotated 45° relative to) an associated radiating patch 7 on the upper or front layer 1. The patches 7 each have a square configuration and are disposed in a row along a centre line C, at regular distances from each other so as to leave gaps d between each pair of adjacent patches 7.

The patches 7 are fed from the two feed channels 6*a*, 6*b* so as to radiate a microwave beam having dual polarization, in this case linear polarization ±45° relative to the centre line C. Of course, the two channels should be electrically isolated from each other.

According to the invention, the isolation between the two channels is substantially improved, typically 10 dB, to a value of at least 30 dB, by means of elongated parasitic elements arranged on both transversal sides of the row of patches 7, in the vicinity of the gap d between adjacent patches.

Figure 7:
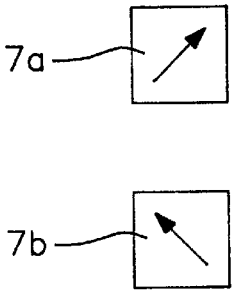
FIGS. 7 and 8 illustrate the inter-channel coupling between two adjacent antenna elements without parasitic elements.
Figure 8:
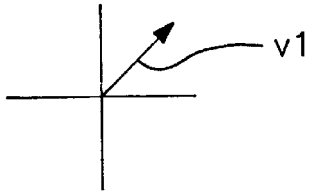

In FIGS. 7–10 the principal operative function of such elongated parasitic elements is illustrated schematically. In FIG. 7, two adjacent antenna elements 7*a*, 7*b* are shown (without parasitic elements). Inevitably, a first channel in the upper element 7*a*, represented by an arrow pointing 45° upwardly to the right, will couple somewhat to the second channel in the lower element 7*b*, represented by an arrow pointing 45° upwardly to the left, although the linearly polarized waves are orthogonal to each other. This direct inter-channel coupling is represented by a phasor V1 as shown in FIG. 8. The inter-channel coupling level, being dependent on the spacing between adjacent antenna elements, is typically about −25 dB.

Figure 9:
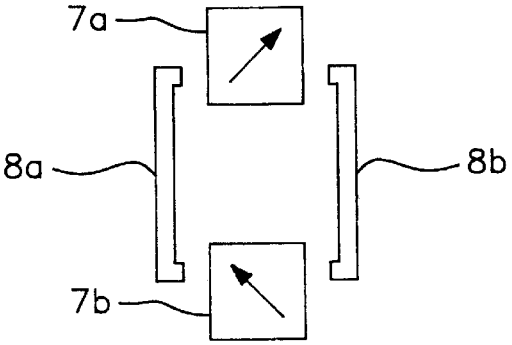
FIGS. 9 and 10 illustrate the corresponding coupling between two adjacent antenna elements having parasitic elements disposed in the vicinity of the gap therebetween.
Figure 10:
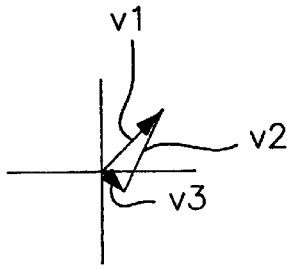

In FIG. 9 two parasitic elements 8*a*, 8*b* have been added. These parasitic elements 8*a*, 8*b* will provide a further inter-channel coupling route, the amplitude of which is approximately of the same order as the direct inter-channel coupling, although shifted in phase by nearly 180° so as to virtually cancel the direct inter-channel coupling. The further inter-channel coupling is represented by a phasor V2 in FIG. 10, resulting in a total inter-channel coupling phasor V3 representing a much lower inter-channel coupling level, typically about −35 dB.

In the preferred embodiment shown in FIGS. 1 and 2, the parasitic elements are constituted by elongated metal strips 8*a*, 8*b* located symmetrically on both sides of the centre line C, outside the region of the patches 7, on the same dielectric layer 1, i.e. substantially in the same plane as the patches. The metal strips 8*a*, 8*b* are longer than the gap d and are disposed along two parallel side lines S1, S2 (FIG. 1).

As indicated above, experiments have shown that the parasitic strips 8*a*, 8*b* effectively reduce the electromagnetic inter-channel coupling between adjacent patches, i.e. from one microwave channel to the other. Moreover, the isolation between the two channels within each one of the patches 7 is maintained. The orthogonality between the two radiated polarizations is also improved.

Figure 3:
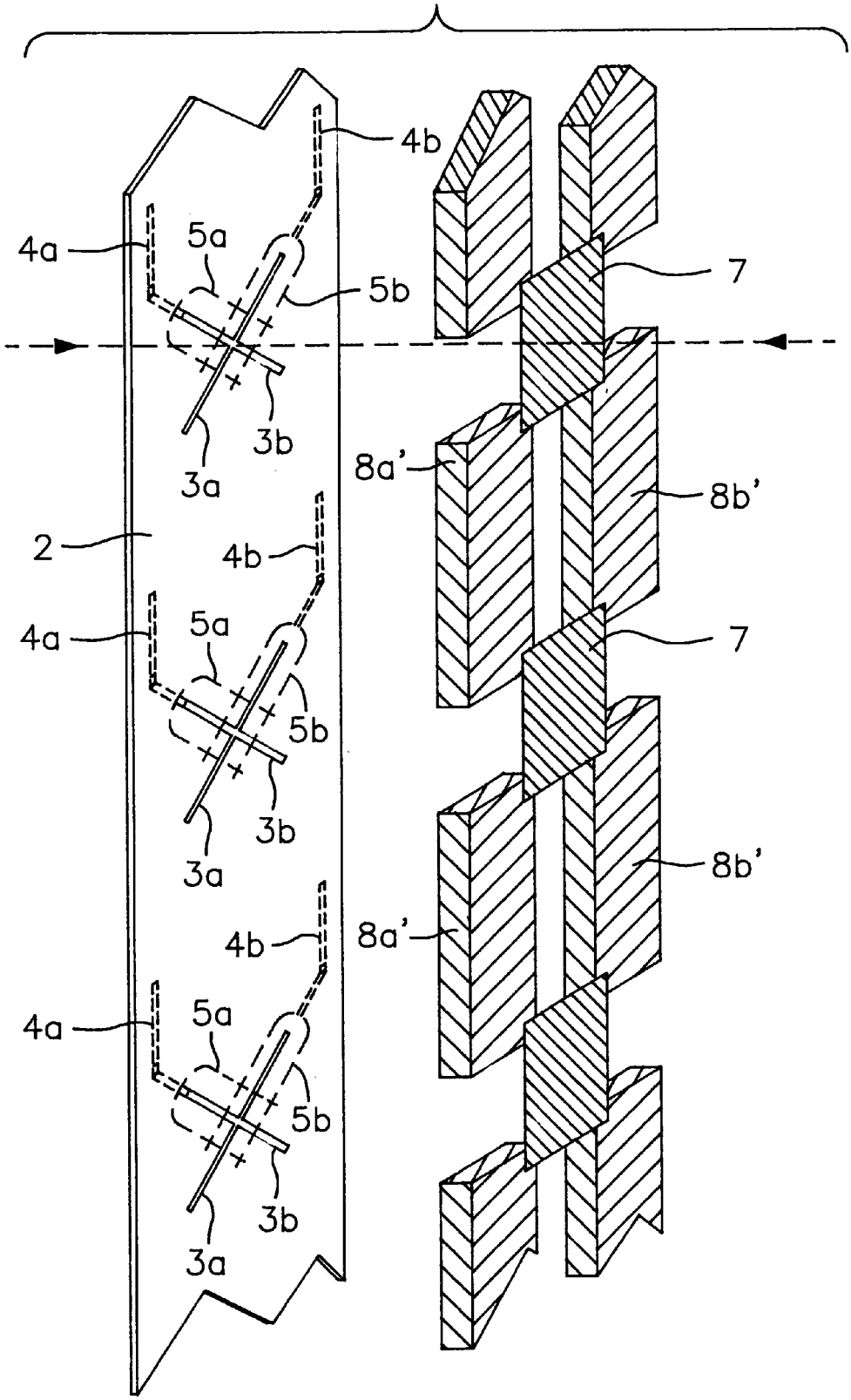
FIG. 3 shows, in an exploded perspective view, a second embodiment with dielectric parasitic elements.

A second embodiment is shown in FIG. 3. Here, the basic structure of the antenna is the same as the one shown in FIGS. 1 and 2. However, the parasitic elements 8'*a*, 8'*b* are constituted by dielectric rods (rather than metallic strips) having a dielectric constant between 2 and 6 and being located closer to the patches 7. If desired, they may serve as spacers and mechanical fasteners so as to secure the mutual positions of the patches 7 and the parasitic elements 8'*a*, 8'*b*.

Figure 4:
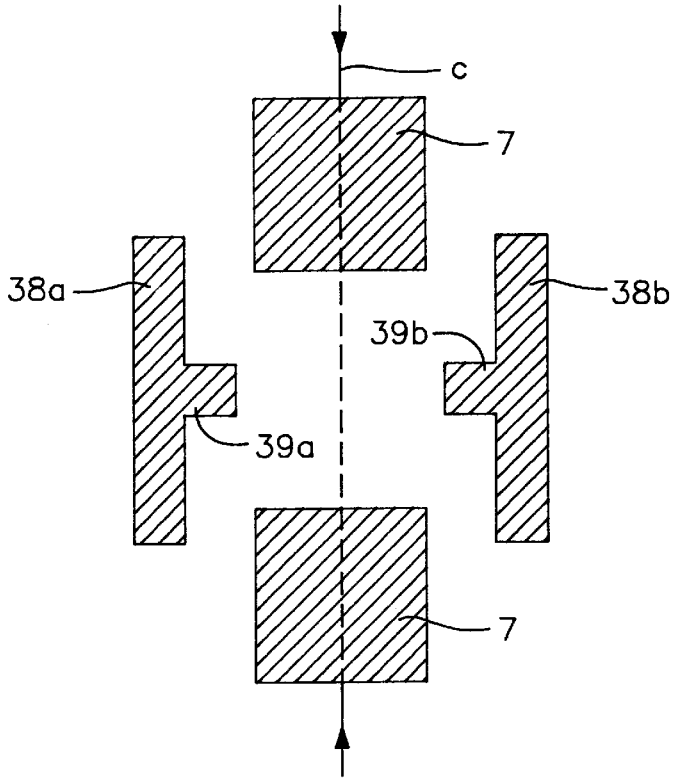
FIGS. 4, 5 and 6 show, in schematic planar views, third, fourth and fifth embodiments with various configurations of conductive parasitic elements.

A third embodiment is illustrated in FIG. 4, which corresponds essentially to the first embodiment (only two antenna elements 7 are shown). The metallic strips 38*a*, 38*b* constitute parasitic elements being formed as elongated rectangles each having a transverse stub 39*a*, 39*b* located at its midportion and extending towards the centre line C.

Figure 5:
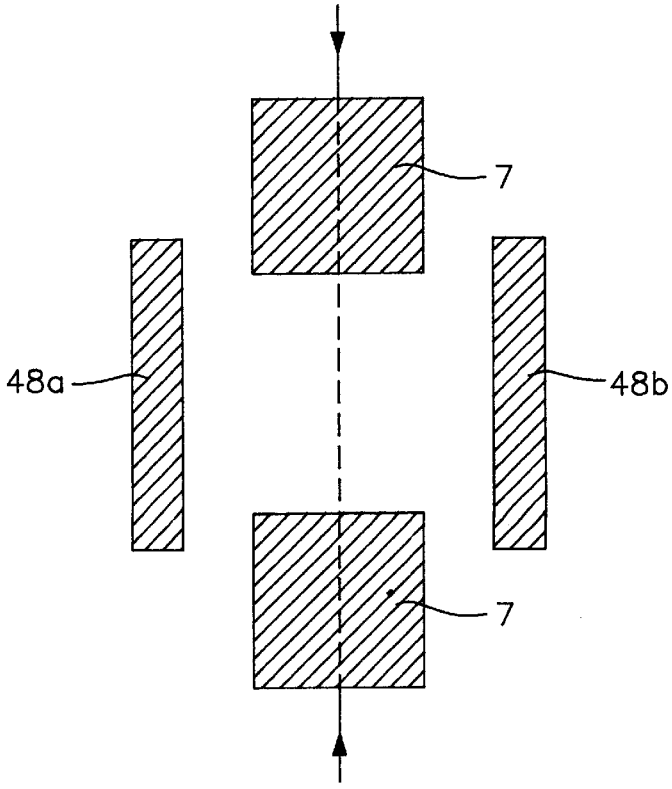

The fifth embodiment, illustrated in FIG. 5, corresponds exactly to the previous embodiment, although the rectangular elements 48*a*, 48*b* do not have any stubs.

Figure 6:
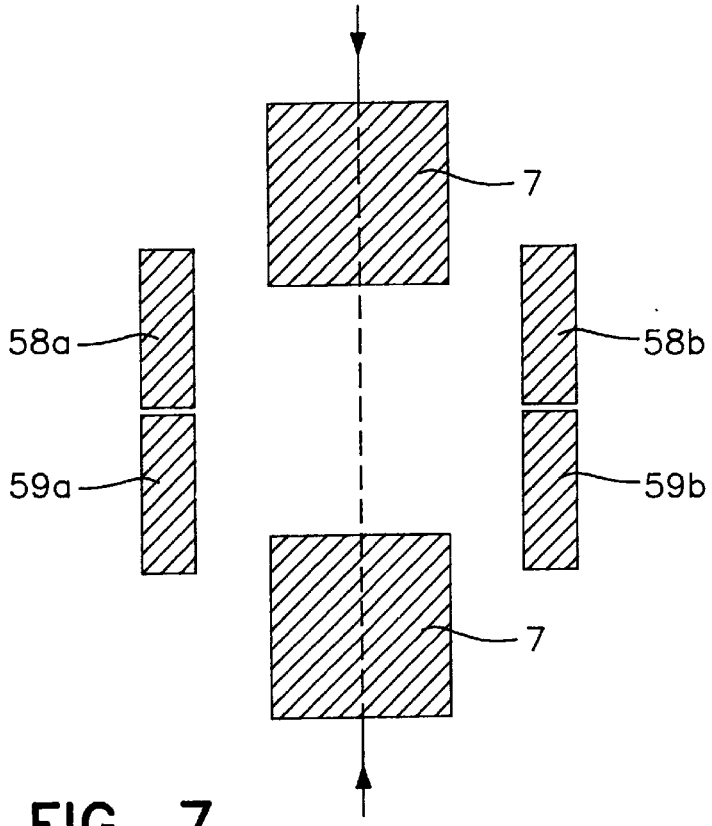

As illustrated in FIG. 6, it is possible to divide the parasitic elements into separate but very closely located portions 58*a*, 59*a* and 58*b*, 59*b*, respectively, disposed longitudinally in series one after the other.

As indicated above, the particular arrangement and form of the parasitic elements may be modified within the scope of claim 1. For example, it is possible to combine metal and dielectric parasitic elements. Some of these elements may be oriented in another direction. Thus, it is not necessary that all elements are parallel to the centre line C. Also, the patches 7 may have some other geometrical shape, provided that they are symmetric upon being rotated 90°, or they may be replaced by antenna elements in the form of conventional dipoles.

Finally, it is possible to dispose further parasitic elements at the transverse sides of each antenna element, in particular so as to enhance the isolation between the two channels within each one of the antenna elements.

What is claimed is:

1. An antenna for receiving and/or transmitting electromagnetic waves, comprising:

an array of antenna elements including at least one longitudinal row of antenna elements located at a distance from each other and defining gaps therebetween, parasitic elements located in the vicinity of the gaps between said antenna elements, two mutually isolated channels that receive and/or transmit dual polarized, mutually orthogonal waves from/to each of said antenna elements, wherein each of said parasitic elements include an elongated portion extending longitudinally substantially in parallel to a centre line of said longitudinal row of antenna elements, whereby each elongated portion has one end adjacent the antenna element and extend adjacent to the gap, and wherein said parasitic elements establish, in addition to an inevitable direct inter-channel coupling between the antenna elements in a respective pair of adjacent antenna elements, a further coupling between the antenna elements in said respective pair, said further coupling is phase shifted relative to said direct coupling to substantially reduce the resulting total inter-channel coupling therebetween.

2. The antenna as defined in claim 1, wherein said parasitic elements are disposed symmetrically with respect to the centre line of said row.

3. The antenna as defined in claim 1, wherein said parasitic elements are made of an electrically conductive material.

4. The antenna as defined in claim 1, wherein said parasitic elements are made of a dielectric material having a dielectric constant greater than 2.

5. The antenna as defined in claim 1, wherein said parasitic elements are constituted by strips wires and/or rods.

6. The antenna as defined in claim 1, wherein the length of each parasitic element is at least $\lambda/8$, $\lambda$ being the wavelength.

7. The antenna as defined in claim 1, wherein at least two of said parasitic elements comprise at least two elongated portions located longitudinally in series one after the other.

8. The antenna as defined in claim 1, wherein at least two of said parasitic elements include an elongated portion having at least one transverse stub.

9. The antenna as defined in claim 1, wherein the parasitic elements are located outside the centre line (C) of said row.

10. The antenna as defined in claim 9, wherein said parasitic elements are located outside the region of said row of antenna elements.

11. The antenna as defined in claim 1, wherein said parasitic elements are located substantially in the same plane as the antenna elements contained in said row.

12. The antenna as defined in claim 11, wherein said antenna elements are constituted by flat patches carried by a dielectric layer, and wherein said parasitic elements are carried by the same dielectric layer.

* * * * *